United States Patent [19]

Brinkel et al.

[11] 4,314,502

[45] Feb. 9, 1982

[54] SAFETY CONTROL SYSTEM FOR DOUBLE-ACTING CYLINDER

[75] Inventors: Edwin P. Brinkel, Royal Oak; Philip J. Dellach, Utica, both of Mich.

[73] Assignee: ISI Fluid Power, Inc., Fraser, Mich.

[21] Appl. No.: 3,411

[22] Filed: Jan. 15, 1979

[51] Int. Cl.[3] ..... F15B 13/042

[52] U.S. Cl. ..... 91/438; 91/439; 91/448; 91/464

[58] Field of Search ..... 91/436, 438, 439, 464, 91/437, 451, 420, 461, 441, 442, 448; 137/596

[56] References Cited

U.S. PATENT DOCUMENTS

| | | | |
|---|---|---|---|
| 3,335,739 | 8/1967 | Rice | 91/436 |
| 3,366,016 | 1/1968 | Anderson | 91/438 |
| 3,385,169 | 5/1968 | Hale et al. | 91/459 X |
| 3,472,127 | 10/1969 | Scheidt | 91/437 |
| 3,543,641 | 12/1970 | DePlante | 91/438 |
| 4,024,796 | 5/1977 | Theobald | 91/464 X |

FOREIGN PATENT DOCUMENTS

| | | | |
|---|---|---|---|
| 1513171 | 6/1978 | United Kingdom | 91/438 |

*Primary Examiner*—Irwin C. Cohen

*Attorney, Agent, or Firm*—Cullen, Sloman, Cantor, Grauer, Scott & Rutherford

[57] ABSTRACT

In combination with a double-acting cylinder having pressure and exhaust ports, a cylinder control valve having a spool having a pair of control positions with pressure, cylinder and exhaust ports, and conduits between the valve cylinder ports and cylinder ports, and a source of compressed air connected to the valve pressure port, a safety control system which comprises a pilot-operated valve housing having a pressure port connected to the source of compressed air, a pilot port and a pair of cylinder ports connected to the cylinder conduits. A valve spool within said housing has first and second control positions with an operative device on the housing which normally biases the safety valve spool to a first control position pressurizing opposite ends of the cylinder and with the pilot port connected to the source of compressed air. A build up of pressure to the pilot port moves the safety valve spool to its second control position, blocking communication between the safety valve and the cylinder ports. The spool of the cylinder control valve has a normal central position blocking the conduits to the cylinder assembly ports. The safety valve spool is adapted to automatically return to its first position on disconnecting pressure from said pressure source, bleeding opposite ends of the cylinder.

2 Claims, 1 Drawing Figure

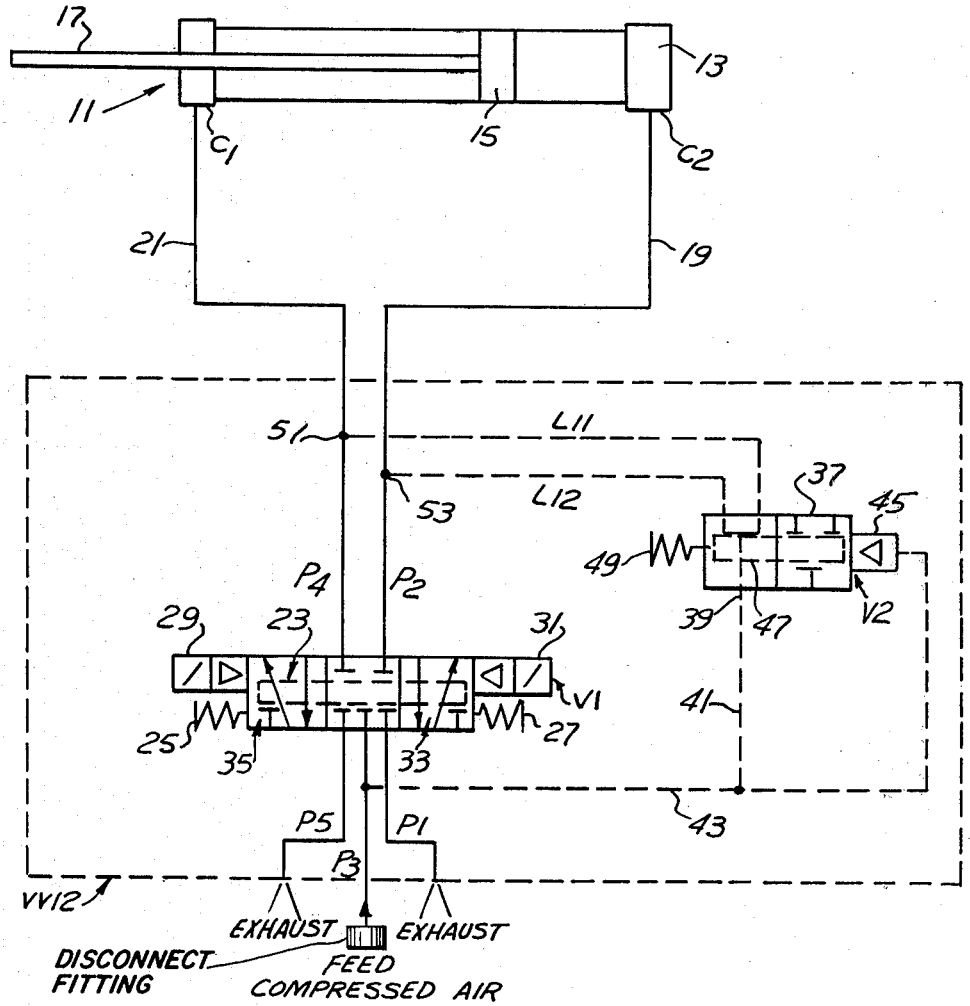
17
11
13
C1
15
C2
21
19
51
L11
53
L12
37
45
49
P4
P2
39
47
V2
29
23
31
V1
41
25
35
33
27
43
P5
P1
P3
VV12
EXHAUST
EXHAUST
DISCONNECT FITTING
FEED COMPRESSED AIR

SAFETY CONTROL SYSTEM FOR DOUBLE-ACTING CYLINDER

BACKGROUND OF THE INVENTION

When a pneumatic cylinder is used as a power source for a machine tool device, many times the cylinder is controlled by a neutral-centered valve. In case of a failure, either in the valve or the cylinder or the controls thereof, the trapped air remains on both sides of the piston. In the event of an unsafe condition, the cylinder may be stopped by allowing the neutral-centered control valve to go to a center position, trapping air on opposite sides of the piston, and stopping the machine tool device in this position.

Should a maintenance person attempt to service the equipment, even if the air is shut off, trapped air will remain on both sides of the piston. Should he, by manually operating the valve, dump the air from either side of the piston, the machine tool device will then move under the expanding air on the opposite side of the piston and may cause injury to himself or other personnel.

SUMMARY OF THE INVENTION

It is an object of the present invention to provide a safety control system incorporating a pilot-operated valve assembly whereby, once the air pressure connected to the safety valve has been turned off, said safety valve automatically drains off the air from either or both sides of the power piston, leaving the equipment exhausted and in a safe condition.

It is a further object to provide, in combination with a double-actingcylinder and a conventional control valve therefor adapted to receive pressurized air and deliver it to opposite ends of said cylinder and exhaust air therefrom, a safety control system for the cylinder assembly which includes a pilot-operated valve assembly connected to the same source of pressurized air and furthermore connected to opposite ends of the cylinder for pressurizing the same and wherein, by disconnecting the source of pressurized air, the safety control valve functions automatically to dump pressurized air from opposite sides of the cylinder assembly, leaving same in a safe condition for servicing.

These and other objects will be seen from the following specification and Claims in conjunction with the appended drawing.

THE DRAWING

The FIGURE is a schematic diagram of a pneumatic control system, showing a double-acting cylinder which may be used to move a mass such as a part of a machine tool and including a valve for controlling reciprocal movements of the piston of said cylinder in conjunction with a safety control valve mechanism.

It will be understood that the above drawing is merely illustrative of a preferred embodiment of the invention and that other embodiments are contemplated within the scope of Claims hereafter set forth.

DETAILED DESCRIPTION OF THE INVENTION

Referring to the drawing, a cylinder assembly is shown at 11, which includes double-acting cylinder 13, reciprocal piston 15 and connected piston rod 17. Said rod projects from the cylinder and is adapted for connection as a power source for a machine tool device, for example.

Said cylinder includes cylinder ports C1 and C2 for receiving and exhausting compressed air from control valve V1 which forms a part of an integrated valve assembly, generally indicated at VV12.

The control valve includes pressure port P3, cylinder ports P2 and P4 and exhaust ports P1 and P5. Suitable conduits 19 and 21 interconnect the respective valve cylinder ports P2 and P4 with cylinder ports C1 and C2, respectively. Reciprocal movements of piston rod 17 is under the control of the reciprocal valve spool 23 within said control valve.

Centering springs 25 and 27 are mounted upon opposite ends of said valve and are adapted to normally bias the spool 23 to a central neutral position which blocks all flow of pressure air through the conduits 19 and 21 between the cylinder assembly and the control valve V1.

Said valve spool has a pair of control positions; namely, the first control position 33 and second control position 35, schematically shown under the respective control of the solenoids 29 and 31 at opposite ends of the cylinder control valve.

With the solenoids deactivated, the springs 25,27 are so balanced that the spool 23 remains in a central neutral blocking position, as shown in the drawing. A safety control valve is generally indicated at V2 as a part of the integrated valve assembly VV12 and includes housing 37 with pressure port 39 connected by conduit 41 and the additional conduit 43 to a source of compressed air designated on the schematic drawing.

The safety valve includes a pilot port 45 and a reciprocal valve spool 47 within said housing. Coil compression spring 49 normally biases spool 47 to a first control position.

When air pressure builds up in conduit 43 sufficient to overcome the compression spring 49, the safety valve spool 47 will move to a second control position acting against the spring 49 normally blocking the flow of pressure air. Thus there is no flow of air under pressure through conduit 43,41 and the intermediate conduits L11 and L12 which are coupled as at 51 and 53 to the cylinder conduits 19 and 21, respectively.

This would be a normal situation of operation wherein, with port P3 pressurized from the source of feed compressed air shown in the drawing. In the neutral central position of the spool 23, all flow is blocked through conduits 19 and 21. Likewise, conduits 41 and 43 have been pressurized but due to the action of the pilot port 45 overcoming by air pressure, the spring 43, the spool in the safety valve has been moved to its second control position, blocking off fluid communication through conduits L11 and L12.

OPERATION

In a practical application of the present air pressure connections between the control valve V1 and the cylinder assembly, a pressure regulator is normally employed in either of the conduits 19 or 21 to counteract for the difference in the piston area between the blind end piston side of the piston and the rod end piston side to thereby maintain the piston and rod in a stationary position at any point in the stroke thereof when fluid communication is blocked through the conduits 19 and 21.

Should an electrical signal be fed to solenoid 29, its pilot section will pressurize the spool 23 overcoming the spring 27 and causing the spool to shift to its first control position designated at 33. Pressurized air is delivered to port P3 and travels through the porting provided shown schematically at 33 through cylinder port P2 and conduit 19 to cylinder port C2 causing the piston 15 to move to the left. The rod end of the cylinder at C1 is exhausting through conduit 21 and valve port P4 and out P5 to atmosphere.

If the electrical signal is removed from solenoid 29 and applied to solenoid 31, the spool 23 reverses and moves to its second control position 35, pressure air passes through valve port P4 and conduit 21 and pressurizing cylinder port C1. Port C2 exhausts back through conduit 19 and valve port P2 and to atmosphere throught exhaust port P1.

If the solenoid signal for both of the solenoids 29 and 31 is interrupted or lost at any particular point in the cylinder rod stroke of the cylinder assembly, spool 23 will go to a neutral central blocking position as to all ports. Accordingly, both ends of the cylinder 13 will be under equal pressure through flow from its respective port.

At the same time, air pressure from conduits 19 and 21 is connected through the conduits L11 and L12. For example, pressurized air from conduit 21 is connected to pilot line L-11 and the pilot line L-12 is connected to conduit 19.

With equal pressure on each side of the cylinder, the rod will stop in whatever position it is at that point in time.

Should maintenance be required on the unit; namely, the cylinder assembly or the connections thereto with some machine tool part, the pressurized air at P3 is exhausted to atmosphere. The conduits 41 and 43 will exhaust. Under the action of the coil spring 49, the spool 47 will shift from the normal closed position, exhausting both sides of the cylinder from ports C1 and C2 through the pilot lines L11 and L12 across the valve V2 through conduit 41 and out conduit 43, thereby exhausting the pilot section 45.

Since no pneumatic pressure is now in the system, and particularly upon opposite sides of the piston 15 of the cylinder assembly, it is in a safe condition for maintenance or service.

While coil compression springs 25 and 27 have been shown as the means for centering the valve spool 23 to the blocking position shown, it is contemplated that the springs could be have substituted therefor sources of pilot air. These would be applied to opposite ends of the spool to maintain the central neutral position shown which blocks the cylinder conduits 19 and 21.

Having described our invention, reference should now be had to the following claims.

We claim:

1. In combination with a double-acting cylinder assembly, including a cylinder with pressure and exhaust ports, a piston defining opposed differential areas and piston rod, a cylinder control valve having a spool having a central position and a pair of control positions, with pressure, cylinder and exhaust ports, cylinder conduits between said control valve cylinder ports and said cylinder ports respectively, a pressure conduit connected at one end to said control valve pressure port and having a open end; and a source of compressed air including a pressure passage means having a disconnect fitting removably connected to said pressure conduit open end;

said pressure conduit on disconnection from said source of compressed air adapted for communication to atmosphere;

a safety control system for said cylinder assembly comprising a pilot operated valve including a housing having a pressure port connected to said pressure conduit, a pilot port connected to said pressure conduit, said pressure and pilot ports being connected to said pressure conduit between said disconnect fitting and said cylinder control valve, and a pair of cylinder ports connected to said cylinder conduits respectively;

a valve spool in said housing having first and second control positions therein;

operative means on said housing normally biasing said safety valve spool to a first control position connecting said safety valve pressure port to both of its cylinder ports and to opposite ends of the cylinder assembly;

a build up of pressure to said pilot port adapted to move the safety valve spool to its second control position, blocking communication between said safety valve pressure port and its cylinder ports;

said cylinder control valve normally controlling the respective movements of said piston;

the spool of said cylinder control valve when in its normal central position, blocking the conduits therefrom to said cylinder assembly ports, both sides of said piston being pressurized;

said safety valve spool automatically returning to its first position, on disconnecting said pressure conduit from said source of compressed air, opposite ends of said cylinder bleeding through said pilot operated valve pressure port and through said pressure conduit to atmosphere;

whereby in the event of a failure in the cylinder assembly with the cylinder control valve spool in its central position and pressurized air trapped upon opposite sides of said piston, on disconnecting said air pressure conduit from said source of compressed air, the trapped air from opposite ends of said cylinder assembly is dumped through said pilot operated valve and through said pressure conduit to atmosphere.

2. In the safety control system of claim 1, said operative means on said safety valve housing being a coiled compression spring.

* * * * *